US006313826B1

(12) United States Patent
Schrum et al.

(10) Patent No.: US 6,313,826 B1
(45) Date of Patent: Nov. 6, 2001

(54) POINTING DEVICE WITH NON-SPRING RETURN MECHANISM

(75) Inventors: Allan E. Schrum, Cameron Park; Michael D. Rogers, El Dorado Hills, both of CA (US)

(73) Assignee: Varatouch Technology Incorporated, Sacramento, CA (US)

( * ) Notice: Subject to any disclaimer, the term of this patent is extended or adjusted under 35 U.S.C. 154(b) by 0 days.

(21) Appl. No.: 09/056,387

(22) Filed: Apr. 7, 1998

(51) Int. Cl.[7] ..... G09G 5/08
(52) U.S. Cl. ..... 345/161; 345/157; 200/5 A
(58) Field of Search ..... 345/156, 157, 345/161, 162, 164; 200/5 A

(56) References Cited

U.S. PATENT DOCUMENTS

| | | | | |
|---|---|---|---|---|
| 4,026,048 | | 5/1977 | Hill et al. | 37/42 |
| 4,414,438 | | 11/1983 | Maier et al. | 200/6 A |
| 4,419,653 | | 12/1983 | Waigand | 338/114 |
| 4,433,217 | | 2/1984 | Griffith | 200/5 R |
| 4,439,648 | | 3/1984 | Reiner et al. | 200/6 A |
| 4,479,392 | | 10/1984 | Froeb et al. | 73/862.68 |
| 4,511,769 | | 4/1985 | Sahakian et al. | 200/6 A |
| 4,604,509 | * | 8/1986 | Clancy et al. | 200/513 |
| 4,680,577 | * | 7/1987 | Strayer et al. | 345/160 |
| 4,687,200 | | 8/1987 | Shirai | 273/148 B |
| 4,769,517 | | 9/1988 | Swinney | 200/6 A |
| 4,896,003 | | 1/1990 | Hsieh | 200/6 A |
| 5,162,775 | | 11/1992 | Kuramochi et al. | 338/114 |
| 5,550,339 | * | 8/1996 | Haug | 200/5 A |
| 5,659,334 | * | 8/1997 | Yaniger et al. | 345/156 |
| 5,675,309 | * | 10/1997 | DeVolpi | 338/68 |
| 5,689,285 | * | 11/1997 | Asher | 345/161 |
| 5,712,660 | * | 1/1998 | Martin | 345/161 |
| 5,815,139 | * | 9/1998 | Yoshikawa et al. | 345/157 |
| 5,889,507 | * | 3/1999 | Engle et al. | 345/161 |
| 5,949,325 | * | 9/1999 | Devolpi | 338/154 |
| 6,067,005 | * | 5/2000 | DeVolpi | 338/47 |

FOREIGN PATENT DOCUMENTS

| | | | |
|---|---|---|---|
| 5-304007 | 11/1993 | (JP) | H01C/10/10 |

* cited by examiner

*Primary Examiner*—Steven Saras
*Assistant Examiner*—Fritz Alphonse
(74) *Attorney, Agent, or Firm*—Townsend and Townsend and Crew LLP

(57) ABSTRACT

A pointing device comprises a stick coupled to a resilient return member which is supported on a substrate along an outer edge to move relative to an upper substrate surface of the substrate. The upper substrate surface has conductive lines and resistive coatings formed thereon or embedded therein. The return member has a conductive surface which is biased with a voltage and is normally spaced from the upper substrate surface. When an user applies an external force to the stick to move the return member toward the substrate, the conductive surface makes electrical contact with the substrate surface and generates a digital signal. The conductive surface is convex to provide rolling contact with the substrate surface to change the contact location. The conductive surface is deformable to allow the area of contact to increase with an increased external force for a change in resistance. The digital signal provides information regarding the speed and direction of movement of the contact between the conductive surface and substrate surface. When the user releases the external force, the resilient return member moves back to its neutral position to separate the conductive surface from the substrate surface.

30 Claims, 10 Drawing Sheets

POINTING DEVICE WITH NON-SPRING RETURN MECHANISM

BACKGROUND OF THE INVENTION

This invention relates generally to pointing devices and, more particularly to an improved pointing device which includes an electrically conductive force member with a non-spring return mechanism for contacting circuitry provided on a substrate surface.

Pointing devices including joysticks are known in the art. Traditional joysticks have been used primarily as a gaming controller, although they have also been employed as general mouse replacement devices. In a typical application, the joystick pointing device is connected via cables to a microcontroller of a computer with a display and a keyboard. The traditional joystick has many moving parts, and the size of the mechanism therein prohibits its use in many applications, including remote controls, keyboards, and notebooks. On the other hand, joysticks have the advantages of reliability and performance.

SUMMARY OF THE INVENTION

The present invention provides a pointing device having a substrate surface on a printed circuit board, glass, paper, ceramic, or plastics that have conductive lines and resistive coatings formed thereon or embedded therein or otherwise provided on the surface. A resilient return member or skirt is supported on the board. The return member is coupled to a stick which can be manipulated by a human finger. The return member has a conductive surface which normally does not make electrical contact with the board without application of external forces. At least the conductive surface of the return member is electrically conductive and is biased with a voltage. When the return member is deflected with an external force on the stick by a user, it deforms and the conductive surface makes electrical contact with the circuitry provided on the substrate surface of the board. The board has electrical contacts (digital) that are closed when an external force is applied to create the electrical contact with the return member. Signals so developed are supplied to a microcontroller either to wake up the microcontroller or to inform the microcontroller regarding the direction and speed of the movement caused by the external force or to perform both functions. Because a digital contact is used, there is no long analog-to-digital conversion time. The equation for analog-to-digital conversion time is (1.1)×(resistance maximum)×(Capacitance)=maximum conversion time, which is needed by analog only joysticks or other pointing devices. The use of only digital input leads in the present invention eliminates the conversion delay time and facilitates rapid movement, causing the stick to have very quick response to the user's initial movements of the stick. The speed is determined, and only limited, by the speed of the microcontroller wake-up routine and the time to send the message to the receiver.

Once there is movement caused by the closure, the microcontroller looks at the analog portion of the signal to determine how much faster to move. When the user releases the force and allows the stick to move back to the neutral position, the firmware can interpret this as a MACRO function. For instance, the release may represent a TAB function or a function of moving to the next icon, or may simply provide a normal function rather than a MACRO function.

Under prolonged deflection of the stick, the conductive surface of the return member makes or increases an electrical contact that produces data received by an analog/digital signal speed/direction interpreter. The microcontroller compares this data with an earlier contact data, and determines the speeds and directions resulting in possible multiple speeds and multiple directions. The possible directions include at least two to an infinite number of directions, while the possible speeds also include at least two to an infinite number of speeds. The larger the displacement of the return member as a result of the deflection of the stick, the further distance from the center of the substrate surface the conductive surface makes contact with the analog/digital circuitry. The further contact causes a variable signal that is a result of angular or rolling displacement of the return member induced by the stick. The substrate surface forms a rolling surface for the rolling contact with the conductive surface of the return member when the stick is deflected and moved angularly.

Upon releasing the stick of all external forces by the user, the resilient return member moves back to its normally neutral position where it does not make contact with the initial digital contacts. The corresponding increase in force on the return member either increases the surface area of contact between the conductive surface and the substrate surface for a change in resistance, or changes the absolute point of contact on the analog/digital contact, thereby changing the point of the voltage potential. This changes the analog voltage. The software in the microcontroller interprets the data relating to this change and directs an output to a relevant receiver that can be connected by a wire or similar structural members.

One aspect of the present invention is a pointing device which comprises a continuous substrate surface having an electrically conductive material and a resistive material. A resilient return member is supported on the substrate surface and has an electrically conductive surface which is spaced from the substrate surface in a first position. A handle is coupled to the resilient return member for moving the resilient return member between the first position and a second position where the electrically conductive surface makes contact with the substrate surface at a contact location.

In accordance with another aspect of the invention, a pointing device comprises a substrate surface having a pattern of electrically conductive material and resistive material. A return member having an electrically conductive surface is supported on the substrate surface along an outer edge to move between a undeflected position where the electrically conductive surface is spaced from the substrate surface and a deflected position where the electrically conductive surface makes contact with the substrate surface.

In accordance with another aspect of this invention, a pointing device comprises an electrically conductive surface. The pointing device further comprises mechanism for supporting the electrically conductive surface relative to a printed circuit board having a continuous board surface with a printed circuit to move between a neutral position in which the electrically conductive surface is spaced from the continuous board surface and a contact position in which the electrically conductive surface makes rolling contact with the printed circuit on the continuous board surface.

BRIEF DESCRIPTION OF THE DRAWINGS

The preferred embodiments of this invention, illustrating all their features, will now be discussed in detail. These embodiments depict the novel and nonobvious pointing device of this invention shown in the accompanying drawings, which are included for illustrative purposes only. These drawings include the following figures, with like numerals indicating like parts.

DESCRIPTION OF THE PREFERRED EMBODIMENT

Figure 1:
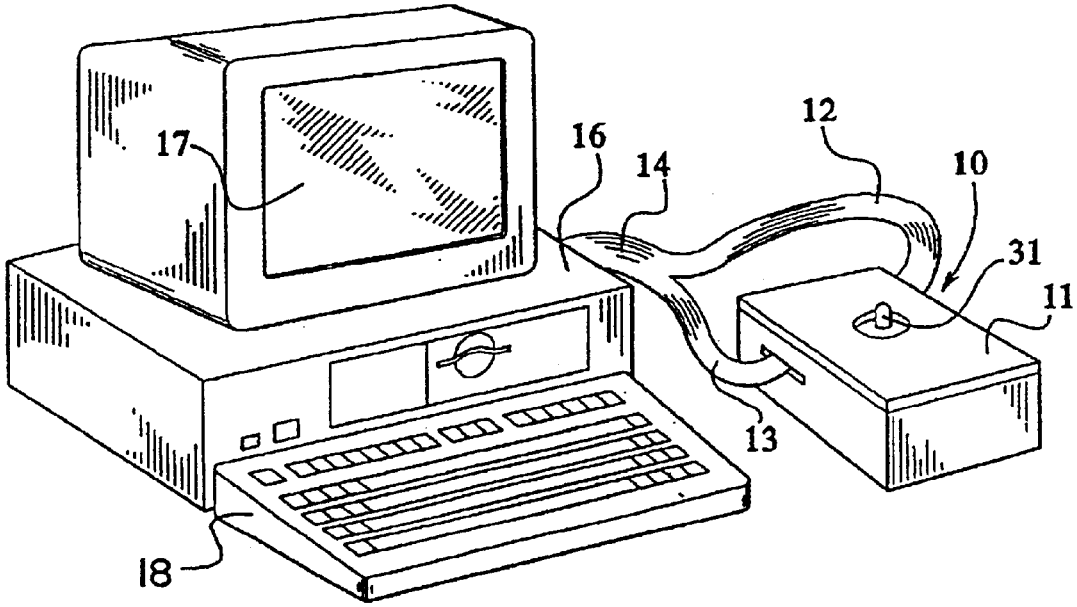
FIG. 1 is a perspective view illustrating a pointing device of the present invention connected to a computer system.

Referring to FIG. 1, a pointing device is shown contained in a container or box 10 having a top wall or cover 11. Although FIG. 1 shows a joystick pointing device 20, the present invention is not limited to joysticks. A pair of cables 12, 13 are coupled to the container 10 and extend from the container 10 to a junction at which the cable 12, 13 join together in a cable 14 that is connected to a microcontroller 16. The microcontroller 16 is associated with a monitor 17 and a keyboard 18.

Figure 2A:
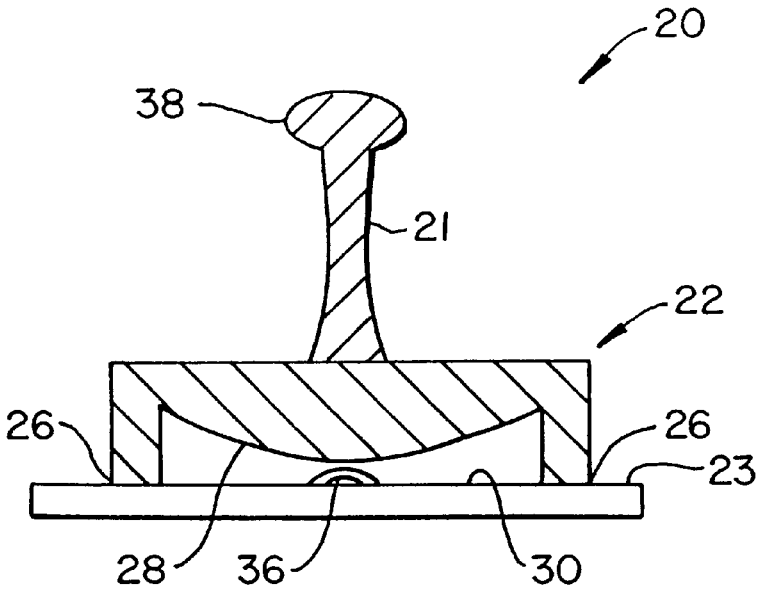
FIG. 2*a* is a partial cross-sectional view illustrating an embodiment of a pointing device of the present invention in an undeflected mode.

Referring to FIG. 2*a*, a pointing device 20 includes a handle or stick 21 coupled to a resilient return member 22 which is disposed on top of a substrate or printed circuit board 23. The resilient return member 22 has a skirt-like structure, and is desirably connected to the substrate 23 along its outer edge 26. The substrate 23 desirably has a continuous upper substrate surface 30 as shown. The outer edge 26 may have any shape. In this embodiment, the pointing device 20 is generally circular and symmetrical. The outer edge 26 is substantially circular in shape, and the resilient return member 22 is a generally circular member with a cross-section through its center having the shape shown in FIG. 2*a*. The stick 21 may be a miniature joystick or a full-size joystick. In addition, the stick 21 may have any length, and may even be eliminated for a control-disk pointing device.

The resilient return member 22 is electrically conductive, at least at a conductive surface 28, which is spaced from the upper substrate surface 30 of the substrate 23 in the neutral, undeformed state shown in FIG. 2*a*. An electrical voltage is applied to the return member 22 to produce an energizing voltage therein. The voltage can be produced by any method known in the art. For example, the voltage can be created by electrically contacting the return member 22 (or at least the conductive surface 28) with one or more electrical conductors or contacts (not shown) spaced along its outer edge 26. In applications where the pointing device 20 is used with microprocessors, the typical voltage applied to the return member 22 is about 3–5 volts. The voltage can be different for other applications.

The substrate 23 in this embodiment is planar in shape and substantially circular, but other shapes are possible. The substrate surface 30 of the substrate 23 has circuit paths or conductive lines and resistive coatings formed thereon or embedded therein or otherwise provided on the surface. Examples of the circuitry on the upper surface 30 of the substrate 23 are given below. In this embodiment, the return member 22 advantageously encloses the upper substrate surface 30 and protects the circuitry on the upper substrate surface 30 from the external environment.

Figure 2B:
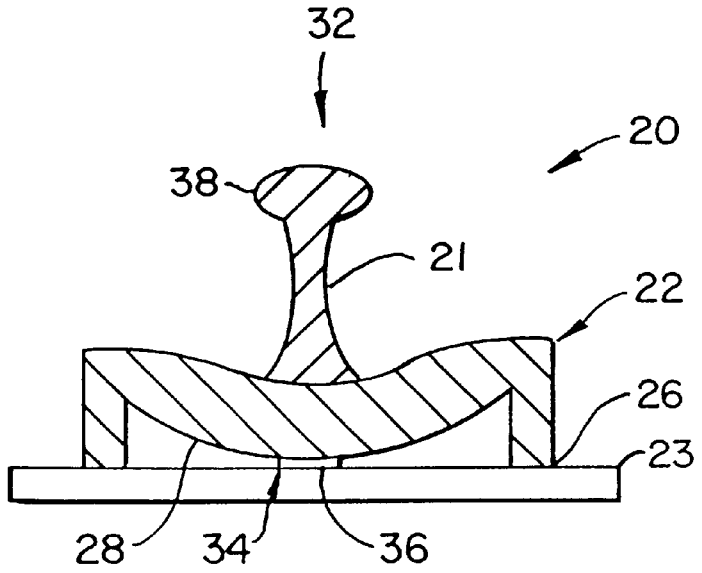
FIG. 2*b* is a partial cross-sectional view illustrating the pointing device of FIG. 2*a* in a deflected mode.

The conductive surface 28 is resiliently supported by the substrate 23 along the outer edge 26 to be movable or displaceable between the rest mode or undeflected mode shown in FIG. 2*a* and a pressed mode or deflected mode shown in FIG. 2*b*. In the deflected mode, the conductive surface 28 is pressed in the direction of the arrow 32 to make contact with the upper surface 30 of the substrate 23 to form a contact location 34.

The conductive surface 28 desirably is curved with a convex shape to roll or rock on the upper substrate surface 30 of the substrate 23 in the pressed mode. As the conductive surface 28 rocks on the upper substrate surface 30 of the substrate 23, the contact location 34 between the conductive surface 28 and the substrate surface 30 is changed. The conductive surface 28 of the return member 22 is advantageously deformable such that the contact location 34 increases in area with an increased deflection when a larger force is exerted on the return member 22. In the embodiment shown in FIG. 2*a*, an optional dome switch 36 is provided at the conductive surface 28. The dome switch 36 is desirably disposed at the central area of the conductive surface 28 which is closest to the upper substrate surface 30 in the undeformed state. The dome switch 36 is a semi-hemispherical stainless steel dome which collapses when depressed.

The stick 21 extends from the return member 22, and may include a digit pad 38 that provides easy operation by a human hand or finger(s) to press the conductive surface 30 toward the substrate 23. In the preferred embodiment, the stick 21 extends generally perpendicularly to the upper surface 30 of the substrate 23, although other orientations for the stick 21 are acceptable. The stick 21 is generally aligned with the dome switch 36 of the return member 22. The stick 21 may be uniform in cross-section between the digit pad 38 and the return member 22, or may be tapered as shown. The stick 21 may be made of a variety of materials, such as plastic or rubber.

In operation, when the stick 21 is pressed downward, the resilient return member 22 is deflected toward the substrate 23. The deflection causes the conductive surface 28 of the return member 22 to engage the upper surface 30 of the substrate 23 and make electrical contact therewith at the contact location 34, as best seen in the illustrated deflected mode in FIG. 2*b*. In this deflected mode, the dome switch 36 acts as a switch by forming a contact closure when it is collapsed under the force of the stick 21 to wake up the microcontroller 16 for mouse-click applications or the like. The surface of the dome switch 36 may be an active part of the circuit to allow microprocessor wake-up capability. The dome switch 36 also serves as a centering device for the resilient return member 22 when it is deflected under the force of the stick 21. The dome switch 36 is an optional feature that is not necessary for the operation of the pointing device 20, since the return member 22 of FIGS. 2*a* and 2*b* is self-centering.

The conductive surface 28 of the return member 22 is electrically conductive and biased with an applied voltage. When a user presses the stick 21 and deflects the return member 22, the conductive surface 28 makes electrical contact with the upper surface 30 of the substrate 23. The substrate 23 has electrical contacts (digital) that are closed when an external force is applied. Signals so developed are supplied to the microcontroller 16 either to wake up the microcontroller 16 (if the dome switch 36 is not included) or inform the microcontroller 16 of the direction and speed of the movement caused by the external force or both. The larger the displacement of the stick 21, the further out the contact location 34 is between the conductive surface 28 and the analog/digital circuitry on the upper substrate surface 30. This produces a variable signal that is due to the angular displacement of the stick 21. Furthermore, the corresponding increase in force on the stick 21 and return member 22 either increases the surface area of contact for a change in resistance, or changes the absolute point of contact on the analog/digital contact on the substrate surface 30, thereby changing the point of the voltage potential. This changes the analog voltage as detected on the substrate surface 30. Using methods known in the art, the detected information can be used to calculate the contact location 34 between the conductive surface 28 of the return member 22 and the substrate surface 30. The software in the microcontroller 16 interprets the data relating to this change and directs an output to a relevant receiver that can be connected by a wire or similar structural members.

When the pointing device 20 is used in applications such as a remote control device, where conservation of battery power is desired, the pointing device 20 desirably includes a digital wake-up feature. The dome switch 36 in the embodiment shown in FIGS. 2*a* and 2*b* can serve as a wake-up switch. The voltage is not applied to the return member 22 when the pointing device 20 is in the rest or undeflected mode of FIG. 2*a*. The voltage is applied only when the dome switch 36 is collapsed to produce a digital wake-up signal, indicating there is contact between the conductive surface 28 of the return member 22 and the upper substrate surface 30 in the pressed mode. As a result, energy is conserved and the battery life can be extended.

Upon release of all external forces on the stick 21, the return member 22 moves back to its normally neutral position and the conductive surface 28 is again spaced from the upper substrate surface 30. The material and geometry of the return member 22 are selected to facilitate repeated deformation and reformation of the return member 22 between the deflected and undeflected mode in a smooth and reliable manner. The resilient return member 22, including the conductive surface 28, may be made of low durometer rubber that is conductive. The return member 22 typically has a very low resistance, for instance, below about 500 ohms. The stick 21 may be made of the same material as the return member 22. In other embodiments, the interior of the resilient return member 22 may be hollow or filled with a suitable filler such as plastic. These components of the pointing device 20 may be made by, for example, molding. In the embodiment shown in FIGS. 2*a* and 2*b*, the stick 21 and return member 22 are separate components that are connected together to form the pointing device 20. In other embodiments, the stick 21 and return member 22 may be made of the same material, and be integrally formed together.

Figure 3:
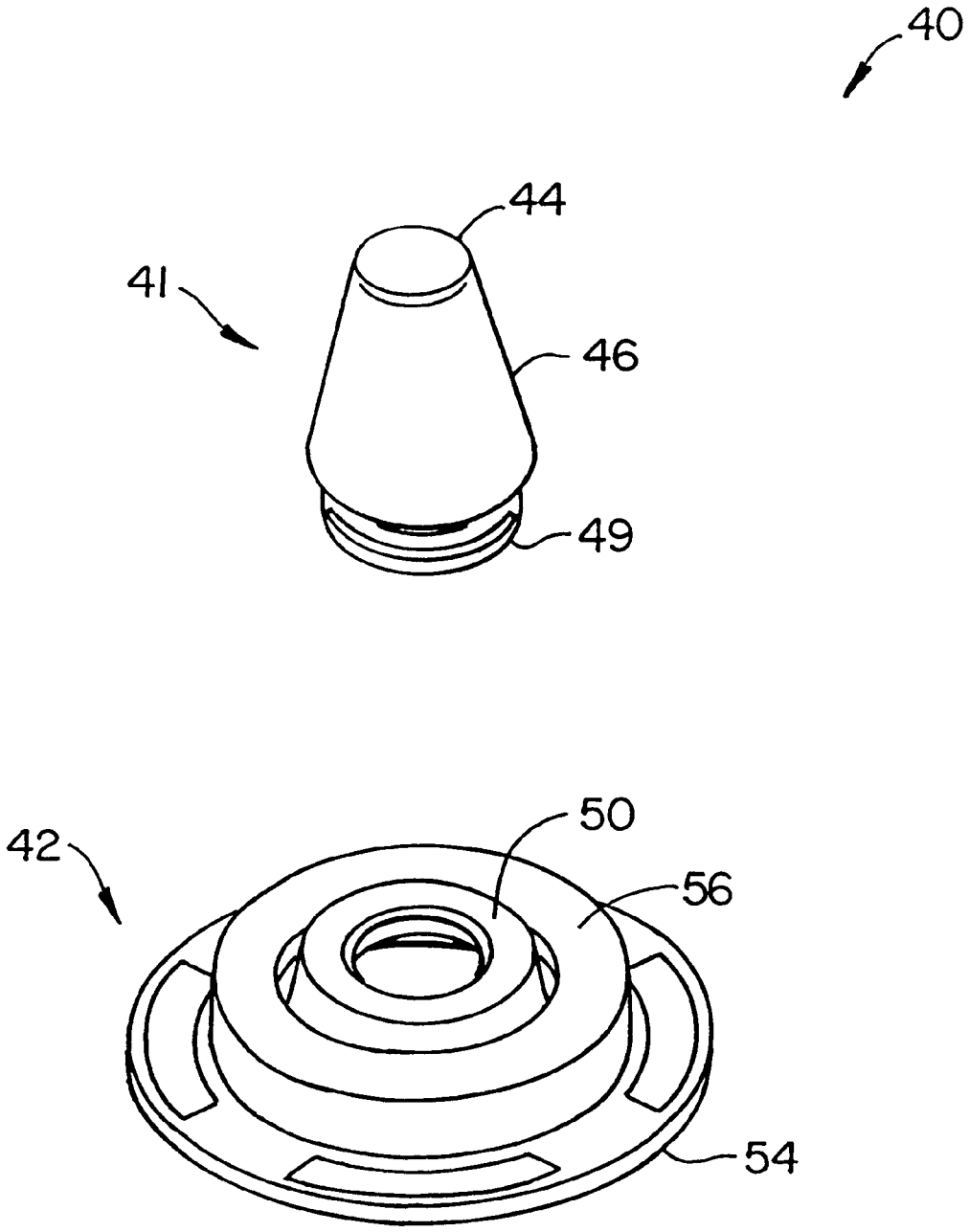
FIG. 3 is an exploded perspective view illustrating another embodiment of a pointing device of the present invention.
Figure 4A:
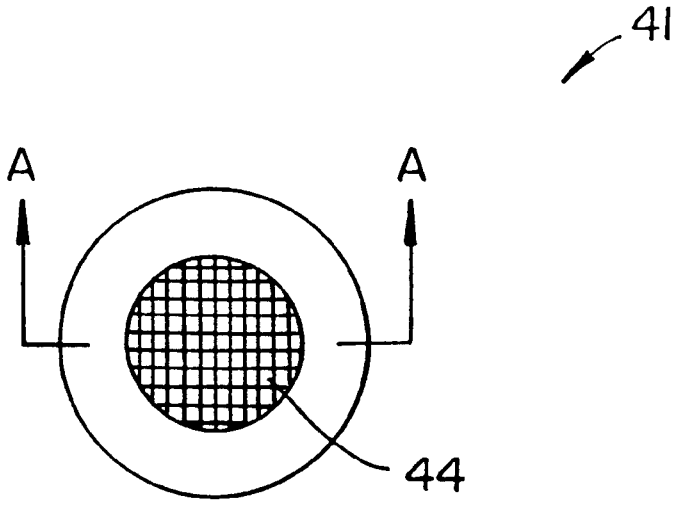
FIG. 4*a* is a top plan view of a stick of the pointing device of FIG. 3.
Figure 4B:
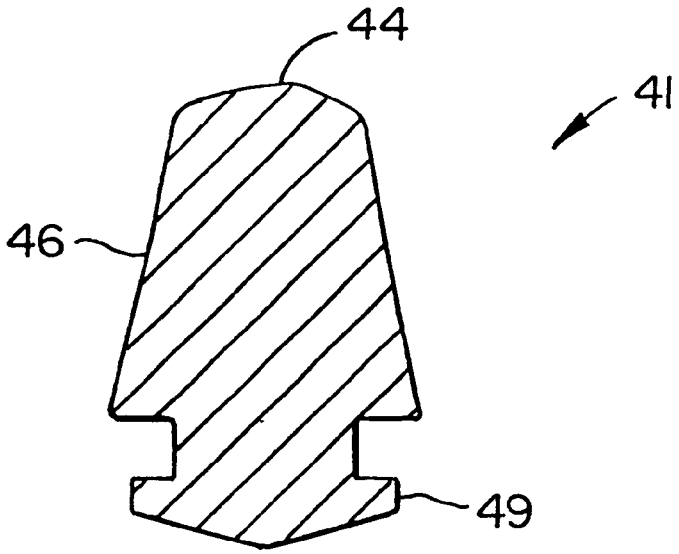
FIG. 4*b* is a cross-sectional view along A—A of the stick of FIG. 4*a*.
Figure 5A:
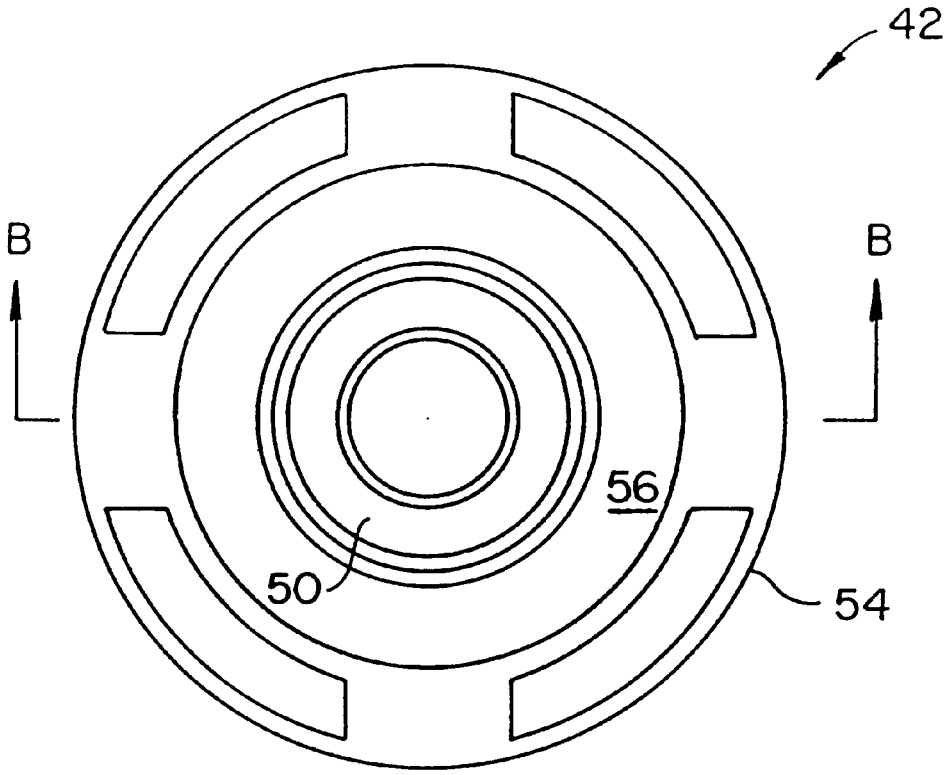
FIG. 5*a* is a top plan view of a resilient return member of the pointing device of FIG. 3.
Figure 5B:
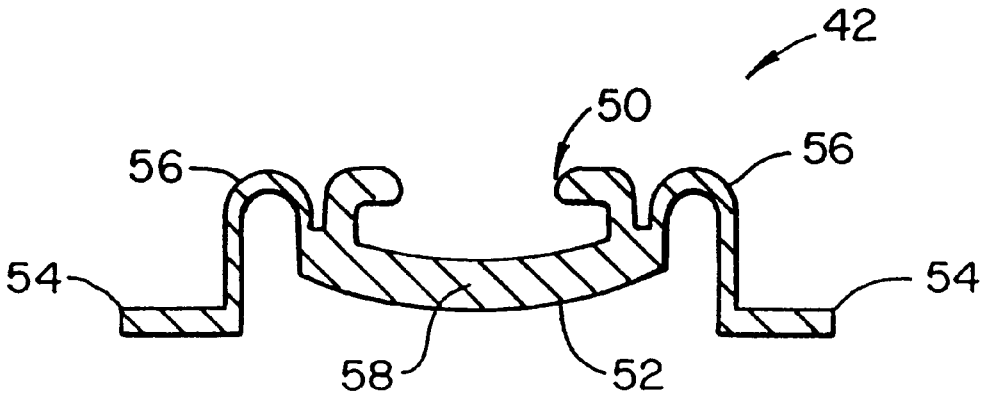
FIG. 5*b* is a cross-sectional view along B—B of the return member of FIG. 5*a*.
Figure 6A:
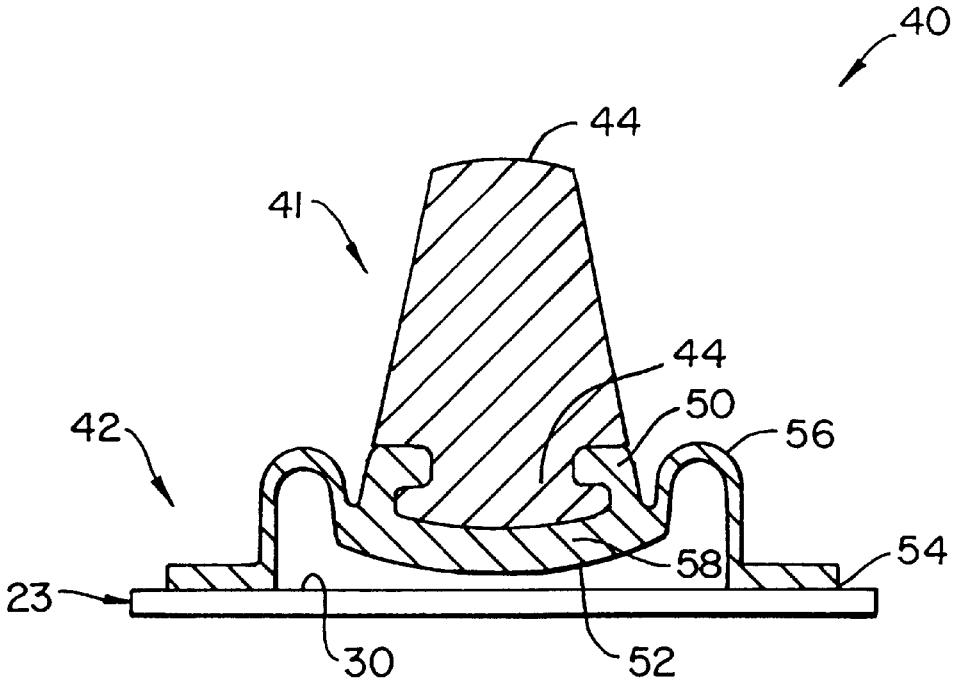
FIG. 6*a* is a cross-sectional view illustrating the pointing device of FIG. 3 in an undeflected mode.

FIG. 3 illustrates another embodiment of a pointing device 40 which comprises a stick 41 and a resilient return member 42. FIGS. 4*a* and 4*b* and FIGS. 5*a* and 5*b* show in further detail respectively the structures of the stick 41 and the return member 42. The stick 41 has a top 44 which desirably includes a grip pattern as best seen in FIG. 4*a* for ease of handling by a human hand or finger. The grip pattern shown includes a cross-cut texture. The stick 41 has a slanted side 46 and a protrusion or boss 49 at the bottom. The boss 49 is shaped to cooperate in a fitted manner with the cavity of a seat 50 provided in the return member 42, as best seen in the assembled pointing device 40 of FIG. 6*a*. The return member 42 has sufficient resiliency to allow the boss 49 to fit into the cavity of the seat 50 to secure easily the stick 41 and the return member 42 together. The design also makes it convenient to separate the stick 41 from the return member 42 and replace the stick 41 with another stick. The return member 42 has a conductive surface 52 disposed below the seat 50. The conductive surface 52 is desirably curved with a convex shape as the conductive surface 28 of the pointing device 20 of FIG. 2*a*. The outer edge 54 of the return member 42 is also similar to the outer edge 26 of the pointing device 20 and connects the return member 42 to the substrate 23 as shown in FIG. 6*a*. An annular arch 56 connects the seat 50 to the outer edge 54 of the return member 42.

Figure 6B:
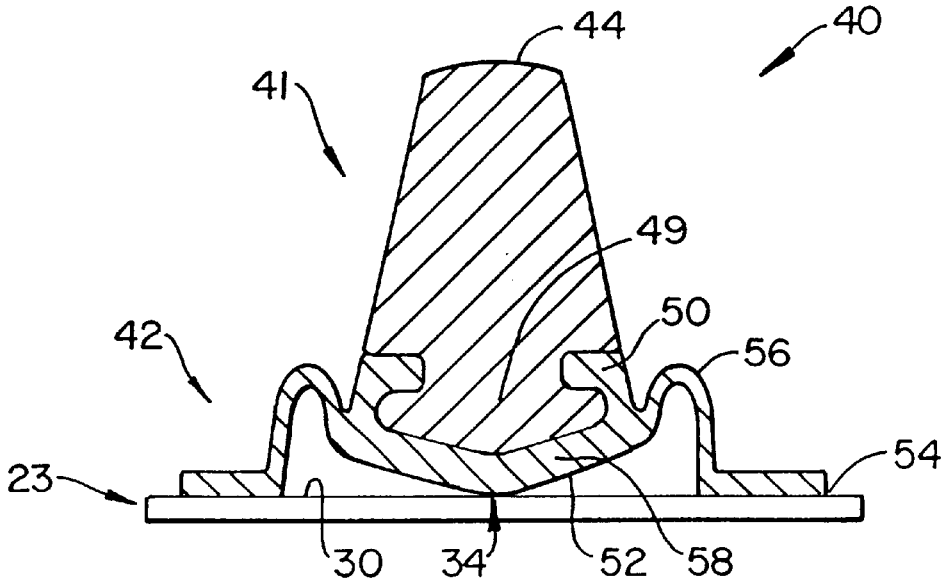
FIG. 6*b* is a cross-sectional view illustrating the pointing device of FIG. 6*a* in a deflected mode.

FIG. 6*a* shows the pointing device 40 in the undeflected mode and FIG. 6*b* shows the pointing device 40 in the deflected mode. The operation of the pointing device 40 is similar to that of the pointing device 20 described above. In the deflected mode, the conductive surface 52 makes contact with the upper surface 30 of the substrate 23 to form a contact location 34. As the conductive surface 52 is rolled on the upper substrate surface 30, the contact location 34 between the conductive surface 52 and the substrate surface 30 is changed. The resilient return member 42, including the conductive surface 52, may be made of low durometer rubber. The stick 41 may be made of the same material as the return member 42, or may be made of other materials such as a hard plastic. The material and geometry of the return member 42 are selected to facilitate repeated deformation and reformation of the return member 42 between the deflected and undeflected mode.

The configuration of the pointing device 40 improves its performance over the pointing device 20 of FIGS. 2*a* and 2*b*. For instance, the annular arch 56 between the seat 50 and the outer edge 54 of the return member 42 provides additional flexibility for the return member 42 to function as a non-spring return mechanism for the pointing device 40. In the embodiment of FIGS. 3–6*b*, the annular arch 56 is thinner than the other portions of the return member 42. Other configurations such as an accordion-like structure (not shown) are possible. The separate stick 41 can isolate and insulate the user's hand from the electrical circuitry and components that include the conductive surface 52 of the return member 42 and the upper surface 30 of the substrate 23. Moreover, the boss 49 is shaped to cooperate in a fitted manner with the cavity of a seat 50 provided in the return member 42. The boss 49 and seat 50 combination allows the thickness of the portion 58 of the return member 42 adjacent the conductive surface 52 to be relatively thin, for instance, compared to the return member 22 of the pointing device 20 of FIGS. 2*a* and 2*b*. As a result, the return member 42 of the pointing device 40 tends to deform and reform more smoothly and reliably. Many other configurations of the pointing device similar to those shown (20, 40) are possible.

Figure 7:
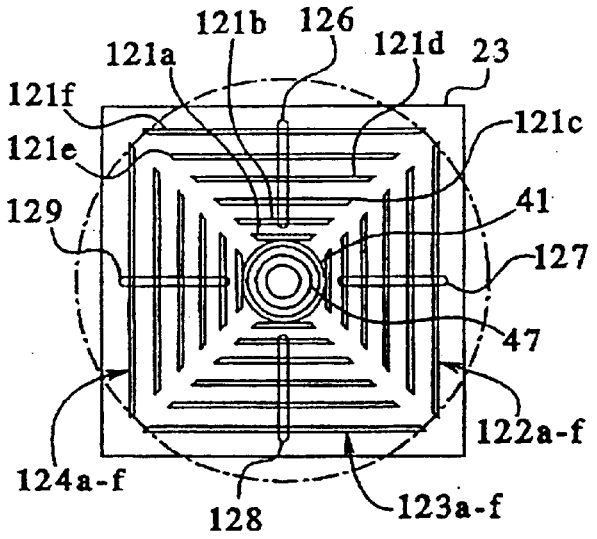
FIG. 7 is a top plan view illustrating an embodiment of the printed circuit board of the pointing device of the present invention.

The printed circuit board 23 may have a wide variety of configurations. An example shown in FIG. 7 is provided herein for illustrative purposes only. Referring to FIG. 7, a set of four conductors 120 are provided near the center of the substrate 23. The circuit board 23 comprises a first plurality of parallel conductors 121*a* through 121*f* mounted on a first segment portion of the board 23 extending from the center. A resistive path 126 extends at right angles to the conductors 121*a* through 121*f* and makes electrical contact therewith. A second plurality of electrical conductors 122*a* through 122*f* are formed in another segment of the printed circuit board 23. A resistive path 127 extends at right angles to the conductors 122*a* through 122*f* and makes electrical contact therewith. A third plurality of conductors 123*a* through 123*f* are also mounted on the board 23 in a different segment, and are electrically connected to a resistive path 128 extending at right angles thereto. A fourth plurality of conductors 124*a* through 124*f* are mounted on another segment of the board 23 and are connected to a resistive path 129 that extends at right angles thereto. When the return member (22, 42) is deflected, the conductive surface (28, 52) engages the conductors 120 near the center of the substrate 23. When the return member (22, 42) is pressed further or rolled, the conductive surface (28, 52) engages the remaining regions of the printed circuit board 23.

Figure 8:
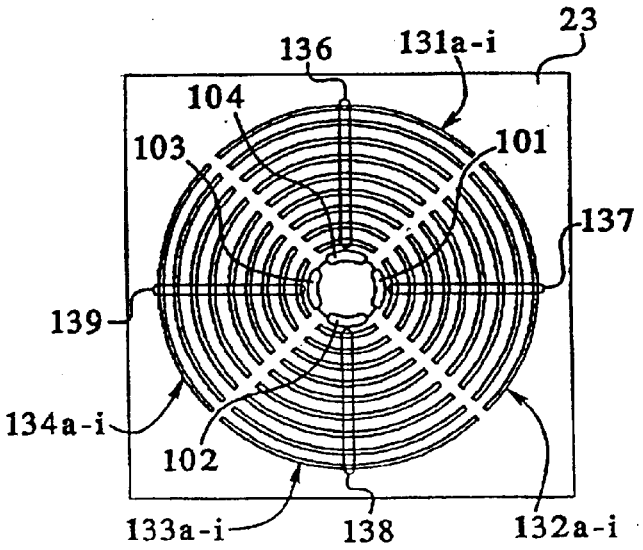
FIG. 8 is a top plan view illustrating another embodiment of the printed circuit board of the pointing device of the present invention.

FIG. 8 shows another embodiment of the printed circuit board 23. Four separate conductive paths 101, 102, 103, 104 are provided near the center of the board 23. A first plurality of printed circuit paths in the form of circular curved segments 131*a*–131*i* are formed in a first segment and are traversed by a resistive path 136. A second plurality of curved segments 132*a*–132*i* are formed on the printed circuit board 23 and traversed by a resistive path 137. A third plurality of curved segments of conducted paths 133*a*–133*i* are formed on the board 23 and traversed by a resistive path 138. A fourth plurality of curved segments 134*a*–134*i* are mounted on another segment of the printed circuit board 23 and are traversed by a resistive path 139. When the return member (22, 42) is deflected, the conductive surface (28, 52) is engageable with the conductive segments 101, 102, 103, 104. When the return member (22, 42) is pressed further or rolled, the conductive surface (28, 52) is engageable with the remaining regions of the printed circuit board 23.

Figure 9:
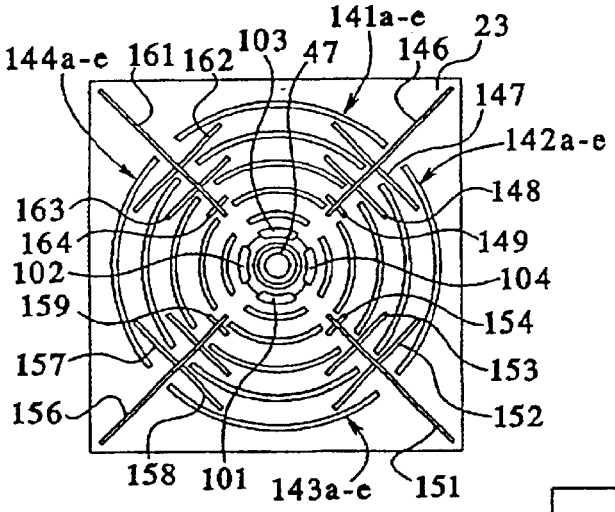
FIG. 9 is a top plan view illustrating another embodiment of the printed circuit board of the pointing device of the present invention.

Referring to FIG. 9, the circuit board 23 differs from that of FIG. 8 in that, instead of the resistive paths 136, 137, 138, 139, radially extending printed circuit paths 146, 151, 156, 161 are mounted in the spaces between four sets of plurality of curved segments 141*a*–141*e*, 142*a*–142*e*, 143a*a*–143*e*, 144*a*–144*e*. Circuit paths 147, 148, 149 extend from the radial circuit path 146 between the curved segments 141*a*–141*e* and 142*a*–142*e*. Conductive paths 152, 153, 154 extend from the radial circuit path 151 between the cured segments 142*a*–142*e* and 143*a*–143*e*. Conductive paths 157, 158, 159 extend from the radial circuit path 156 between the curved segments 143*a*–143*e* and 144*a*–144*e*. Conductive paths 162, 163, 164 extend from the radial circuit path 161 between the curved segments 144*a*–144*e* and 141*a*–141*e*. The conductive segments 101, 102, 103, 104 remain near the center of the substrate 23.

Figure 10:
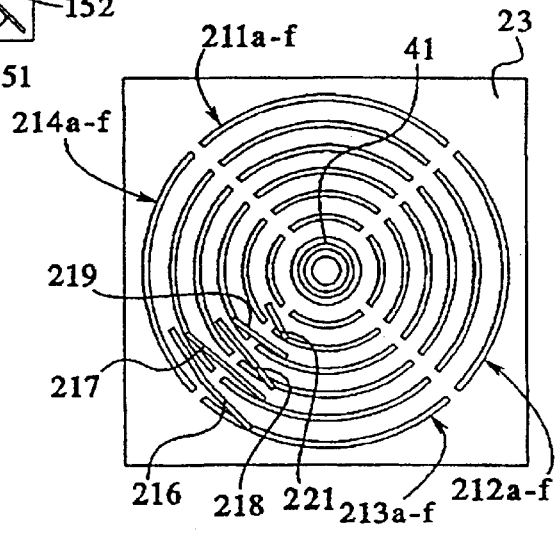
FIG. 10 is a top plan view illustrating another embodiment of the printed circuit board of the pointing device of the present invention.

Referring to FIG. 10, the substrate 23 also includes the conductive segments 101, 102, 103, 104 near the center. The circuit paths 216, 217, 218, 219, 221 are interwoven between the curved circuit paths such as 213*a*–213*f* and 214*a*–214*f*, and extend at right angles which are not perpendicular to the radials so as to increase the quantity of speeds that are available in diagnosis. Although not shown, the interwoven fingers 216–221 may be formed between the other segments, such as between 212*a*–212*f* and 213*a*–213*f*, between 211*a*–211*f* and 213*a*–213*f*, between 211*a*–211*f* and 212*a*–212*f*, and between 211*a*–211*f* and 214*a*–214*f*.

Figure 11:
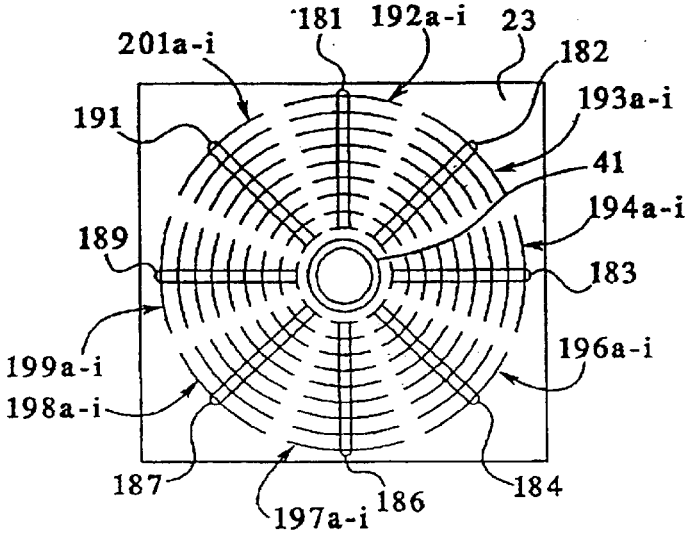
FIG. 11 is a top plan view illustrating another embodiment of the printed circuit board of the pointing device of the present invention.

In FIG. 11, the printed circuit board 23 is formed with additional conductive, separated curve segments that increase the angular resolution of the pointing device (20, 40). The substrate 23 includes eight conductive segments 101, 102, 103, 104, 105, 106, 107, 108 near the center. First concentric curved segments 192*a*–192*i* are traversed by a resistive path 181. Second segments 193*a*–193*i* are traversed by a resistive path 182. Third segments 194*a*–194*i* are traversed by a resistive path 183. Fourth segments 196*a*–196*i* are traversed by a resistive path 184. Fifth segments 197*a*–197*i* are traversed by a resistive path 186. Sixth segments 198*a*–198*i* are traversed by a resistive path 187. Seventh segments 199*a*–199*i* are traversed by a resistive path 189. Eighth segments 201*a*–201*i* are traversed by a resistive path 191. The configuration has an increased angular resolution over the other embodiments by, for example, a factor of two.

Figure 12:
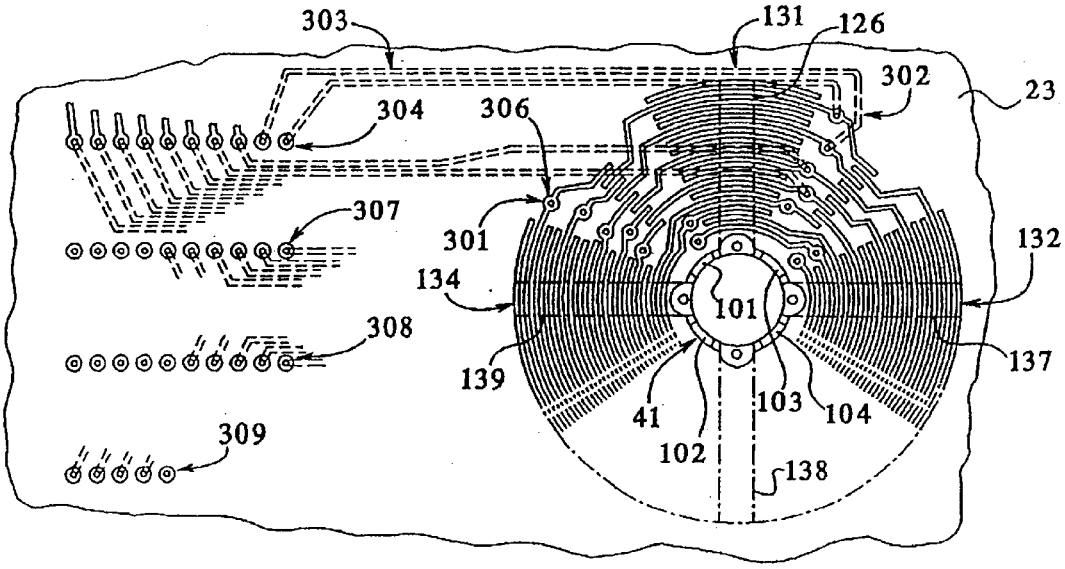
FIG. 12 is a top plan view illustrating the electrical paths on a printed circuit board.
Figure 13:
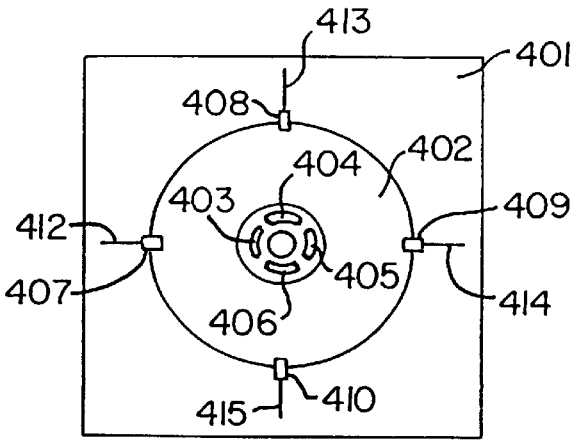
FIG. 13 is a top plan view illustrating another embodiment of the printed circuit board of the pointing device of the present invention.
Figure 14:
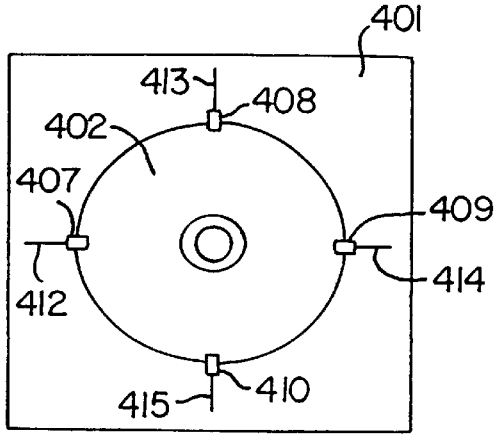
FIG. 14 is a top plan view illustrating the resistive coating of the printed circuit board of FIG. 13.

FIG. 12 illustrates in detail the manner of connecting the various electrical conductive paths of the printed circuit board 23 to an external circuit. In this example, the conductive portions 101, 102, 103, 104 formed near the center of the board 23 are connected to terminals that are in turn connected by conductive paths to external terminals such as the terminal 309 shown in FIG. 12. Curved segments 131 are connected to different terminals and are further connected by leads such as the leads 302, 303 to different terminals 304. Other segments are connected to different terminals such as the terminal 306 that are in turn connected via conductive paths to different remote terminals such as the remote terminal 304.

FIGS. 13–16 illustrate a substrate 401 having an annular resistive material layer 402 formed thereupon to provide a continuous resistive path. Conductive pads 407, 408, 409, 410 contact the outer edges of the annular layer 402. Electrical leads 412, 413, 414, 415 are respectively connected to the conductive pads 407, 408, 409, 410. Digital input conductive traces 403, 404, 405, 406 are formed on the substrate 401 inside the region bounded by the annular resistive material layer 402.

Figure 15:
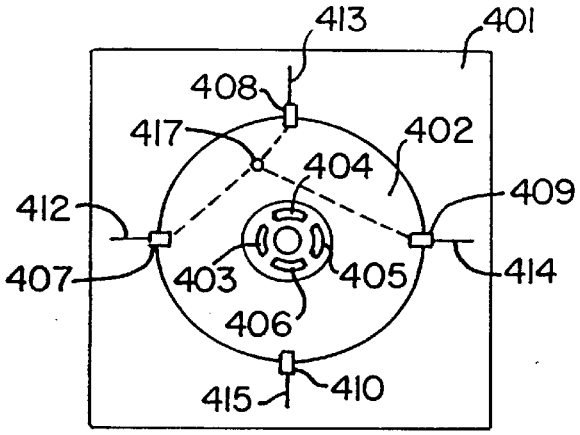
FIG. 15 is a top plan view illustrating the point of triangulation of the printed circuit board of FIG. 13.
Figure 16:
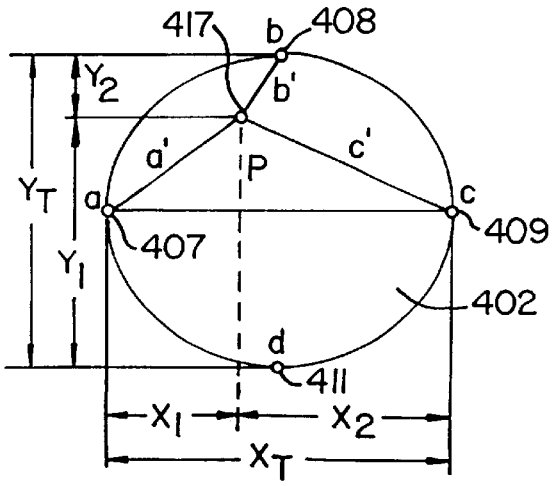
FIG. 16 is a top plan view illustrating the theory of triangulation for the printed circuit board of FIG. 13.

In operation, when the stick (21, 41) is deflected, the return member (22, 42) deforms and the conductive surface (28, 52) engages the resistive layer 402 at a point. For instance, the point of contact as shown in FIG. 15 is a point (P) 417. The resistive value at the point P may be computed using a method illustrated in FIG. 16. The coordinate of the point P is determined by finding the shortest distance from a, b, c, d using the analog version. After the coordinate of the point P is found, triangulation is performed between the three closest points with respect to their polar positions. In one example:

$$Y_T = \text{constant}$$

$$X_T = \text{constant}$$

$$y_1 + y_2 = Y_T$$

$$x_1 + x_2 = X_T$$

$$[(x_1)^2 + (y_1 - 0.5\ Y_T)^2]^{1/2} = a'$$

$$[(y_2)^2 + (0.5X_T - x_1)^2]^{1/2} = b'$$

$$[(X_2)^2 + (y_2)^2]^{1/2} = c'$$

Therefore, the voltage at the contact point P can be determined relative to the contacts 407, 408, 409, 410. From these values, the position of the point P can be determined.

It will be understood that the above-described arrangements of apparatus and methods therefrom are merely illustrative of applications of the principles of this invention and many other embodiments and modifications may be made without departing from the spirit and scope of the invention as defined in the claims.

What is claimed is:

1. A pointing device comprising: a continuous substrate surface having an electrically conductive material and a resistive material; a resilient return member being supported on the substrate surface and having an electrically conductive surface which is spaced from the substrate surface in a first position; and a handle coupled to the resilient return member for moving the resilient return member between the first position and a second position where the electrically conductive surface makes contact with the substrate surface at a contact location, the electrically conductive surface being movable by the handle to rock on the continuous substrate surface in any direction relative to a center on the continuous substrate surface to change the contact location therewith.

2. The pointing device of claim 1, wherein the electrically conductive surface is curved.

3. The pointing device of claim 1, wherein the electrically conductive surface is dome-shaped.

4. The pointing device of claim 1, wherein the electrically conductive surface is deformable by the handle to change a size of the contact location with the substrate surface.

5. The pointing device of claim 1, wherein the electrically conductive surface is biased with a voltage.

6. The pointing device of claim 1, wherein the electrically conductive surface has a center area which is spaced closest to the substrate surface in the first position.

7. The pointing device of claim 6, further comprising a dome switch disposed at the substrate surface generally opposite from the center area of the electrically conductive surface.

8. The pointing device of claim 6, wherein the handle is generally aligned with the center area of the electrically conductive surface.

9. The pointing device of claim 1, wherein the resilient return member comprises a low durometer rubber.

10. The pointing device of claim 1, wherein the resilient return member has an outer edge which is connected to the substrate surface.

11. The pointing device of claim 1, wherein the resilient return member encloses the substrate surface from external environment.

12. The pointing device of claim 1, wherein the handle is releasably connected to the resilient return member.

13. The pointing device of claim 1, wherein the resilient return member includes a flexible arch which resiliently supports the electrically conductive surface relative to the substrate surface.

14. The pointing device of claim 13, wherein the flexible arch is substantially annular.

15. A pointing device comprising: a substrate surface having a pattern of electrically conductive material and resistive material; and a return member having an electrically conductive surface and being supported on the substrate surface along an outer edge to move between an undeflected position where the electrically conductive surface is spaced from the substrate surface and a deflected position where the electrically conductive surface makes rolling contact with the pattern of the substrate surface in any direction relative to a center on the substrate surface, the outer edge of the return member being generally fixed on the substrate surface.

16. The pointing device of claim 15, wherein the outer edge of the return member is substantially circular.

17. The pointing device of claim 15, wherein the return member includes a seat having a cavity for receiving a handle.

18. The pointing device of claim 17, wherein the seat is generally aligned with a center region of the electrically conductive surface.

19. The pointing device of claim 18, wherein the center region of the electrically conductive surface is spaced closest to the substrate surface in the undeflected position.

20. The pointing device of claim 17, wherein the seat is deformable for resiliently receiving a boss of the handle into the cavity.

21. The pointing device of claim 15, wherein the return member includes a resilient arch between the outer edge and the electrically conductive surface.

22. The pointing device of claim 15, wherein the electrically conductive surface is deformable.

23. A pointing device comprising: an electrically conductive surface; and means for supporting the electrically conductive surface relative to a printed circuit board having a continuous board surface with a printed circuit to move between a neutral position in which the electrically conductive surface is spaced from the continuous board surface and a contact position in which the electrically conductive surface makes rolling contact with the printed circuit on the continuous board surface in any direction relative to a center on the continuous board surface, the continuous board surface including an electrically conductive material and a resistive material.

24. The pointing device of claim 23, wherein the electrically conductive surface is curved.

25. The pointing device of claim 24, wherein the electrically conductive surface is convex.

26. The pointing device of claim 23, wherein the electrically conductive surface is deformable.

27. The pointing device of claim 23, further comprising a dome switch disposed at the board surface.

28. The pointing device of claim 27, wherein the dome switch is disposed at a location where the electrically conductive surface is spaced closest to the board surface of the printed circuit board in the neutral position.

29. The pointing device of claim 23, wherein the means is connected to an outer edge of the continuous board surface.

30. The pointing device of claim 15, wherein the substrate surface is a continuous surface with no openings.

* * * * *